US010840608B2

(12) United States Patent
Lahti et al.

(10) Patent No.: US 10,840,608 B2
(45) Date of Patent: Nov. 17, 2020

(54) WAVEGUIDE ANTENNA STRUCTURE

(71) Applicant: Intel Corporation, Santa Clara, CA (US)

(72) Inventors: Saku Lahti, Tampere (FI); Mikko S. Komulainen, Tampere (FI)

(73) Assignee: Intel Corporation, Santa Clara, CA (US)

( * ) Notice: Subject to any disclaimer, the term of this patent is extended or adjusted under 35 U.S.C. 154(b) by 1089 days.

(21) Appl. No.: 14/865,314

(22) Filed: Sep. 25, 2015

(65) Prior Publication Data

US 2017/0093049 A1 Mar. 30, 2017

(51) Int. Cl.

| | |
|---|---|
| ***H01Q 21/28*** | (2006.01) |
| ***H01Q 5/35*** | (2015.01) |
| ***H01Q 9/42*** | (2006.01) |
| ***H01Q 13/02*** | (2006.01) |
| ***H01Q 9/30*** | (2006.01) |
| ***H01Q 13/00*** | (2006.01) |

(52) U.S. Cl.

CPC ..... *H01Q 21/28* (2013.01); *H01Q 5/35* (2015.01); *H01Q 9/30* (2013.01); *H01Q 9/42* (2013.01); *H01Q 13/00* (2013.01); *H01Q 13/02* (2013.01)

(58) Field of Classification Search

CPC ..... H01Q 5/35; H01Q 13/00–02; H01Q 21/28
See application file for complete search history.

(56) References Cited

U.S. PATENT DOCUMENTS

| | | | | |
|---|---|---|---|---|
| 2,912,695 | A * | 11/1959 | Cutler | H01P 1/211 343/781 R |
| 9,130,261 | B2 * | 9/2015 | Chang | H01Q 9/0421 |
| 9,761,957 | B2 * | 9/2017 | Kwiatkowski | H01Q 21/28 |
| 10,270,186 | B2 * | 4/2019 | Teshima | H01Q 21/28 |
| 2011/0194240 | A1 * | 8/2011 | Hansen | G06F 1/1698 361/679.28 |
| 2015/0085459 | A1 * | 3/2015 | Pu | H01Q 1/243 361/782 |
| 2016/0204509 | A1 * | 7/2016 | Zhai | H01Q 13/06 343/725 |

FOREIGN PATENT DOCUMENTS

| | | | |
|---|---|---|---|
| CN | 1525597 | A | 9/2004 |
| CN | 1641933 | A | 7/2005 |
| CN | 101263632 | A | 9/2008 |
| CN | 201503917 | U | 6/2010 |
| CN | 104134860 | A | 11/2014 |
| CN | 104466353 | A | 3/2015 |
| WO | 2012020970 | A2 | 2/2012 |

OTHER PUBLICATIONS

Office Action dated Oct. 26, 2018 for Chinese Patent Application No. 201610685830.1.

* cited by examiner

*Primary Examiner* — Graham P Smith
*Assistant Examiner* — Amal Patel
(74) *Attorney, Agent, or Firm* — Schiff Hardin LLP

(57) ABSTRACT

An antenna structure having a waveguide configured to operate as at least a portion of an antenna. Also, the waveguide may be configured to operate as a first antenna, and the waveguide has a hole configured to operate as a second antenna.

21 Claims, 4 Drawing Sheets

WAVEGUIDE ANTENNA STRUCTURE

TECHNICAL FIELD

The present disclosure generally relates to an antenna structure, and more specifically, to an antenna structure having a waveguide configured to operate as at least a portion of an antenna.

BACKGROUND

High data rate wireless communication systems operating at millimeter-wave frequencies, such as a system developed by Wireless Gigabit Alliance (WiGig) operating over the 60 GHz unlicensed frequency band, are increasing in popularity. Millimeter-wave signals have high frequencies of 30-300 GHz, and engage in short range communication at relatively high data rates. While a waveguide can be configured as a millimeter-wave antenna, the waveguide occupies much space required by other antennas that also need to be integrated within a wireless communication device.

DESCRIPTION OF THE ASPECTS

The present disclosure is directed to an antenna structure comprising a waveguide configured to operate as at least a portion of an antenna.

Figure 1:
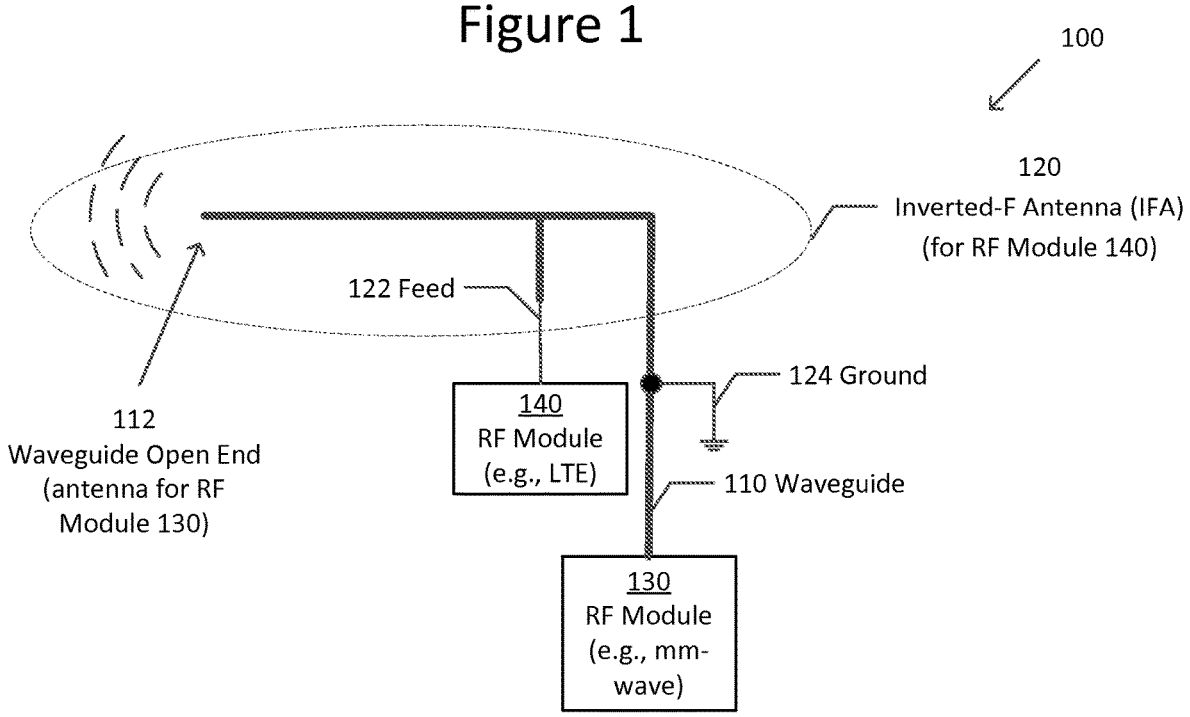
FIG. 1 illustrates a schematic diagram of an antenna structure in accordance with an aspect of the disclosure.

FIG. 1 illustrates a schematic diagram of an antenna structure 100 in accordance with an aspect of the disclosure. The antenna structure 100 is configured to operate simultaneously as an inverted-F antenna (IFA) 120 and a millimeter-wave antenna 112, as described in detail below. By having the same structure 100 operate simultaneously as more than one antenna, space is conserved.

The antenna structure 100 comprises a waveguide 110, an IFA 120, a radio frequency (RF) module 130, and a RF module 140. The IFA 120 has a feed 122 and a ground 124.

The waveguide 110 guides millimeter-wave signals from/to the RF module 130 to enable the millimeter-wave signals to propagate with minimal energy loss. The waveguide 110 may be a cylindrical or rectangular tube made of a low loss dielectric material, such as plastic, and plated with a conducting material, such as metal. Alternatively, the waveguide 110 may be made of a conducting material. The open end 112 of the waveguide 110 acts as a millimeter-wave antenna.

The IFA 120 is formed from a portion of the waveguide 110 located above the ground 124 and is shaped as an inverted-F. The IFA 120 and the waveguide 110 are thus made of the same tube. An IFA is a well-known type of antenna widely used in wireless communication devices, but IFAs are conventionally formed of wire rather than a waveguide. The ground 124 is located at one end of the IFA 120, and a waveguide open end 112 is located at the other end. A feed 122 couples the IFA 120 to the RF module 140.

The IFA 120 requires the ground 124, but the waveguide 110 does not. The ground 124 may be a ground plane comprised of, for example, e.g. a printed circuit board and conductive mechanics parts, as commonly found in wireless communication devices. The ground 124 effectively isolates the portion of the waveguide 110 that is shaped into the IFA 120 from the rest of the waveguide 110 located on the other side of the ground 124. The ground 124 grounds the outside of the waveguide 110, but millimeter-wave signals still propagate through the inside of waveguide 110. The ground 124 allows the waveguide 110 to be routed anywhere within a wireless communication device without affecting the IFA 120.

A millimeter-wave antenna is constructed from the open end 112 of the waveguide 110. While it is possible to construct a waveguide antenna for lower frequencies, such an antenna would be too large to be practical for use in portable devices.

The RF module 130 is a circuit configured to transceive radio signals via the millimeter-wave antenna 112. The RF module 140 is configured to transceive radio signals via the IFA 120. RF modules are known, and for the sake of brevity, a description is not provided here.

The antenna structure 100 thus comprises at least two antennas—the millimeter-wave antenna 112 and the IFA 120. The millimeter-wave antenna is the open end 112 of the waveguide 110; the millimeter wave travels inside the waveguide tube 110 and exits out of the open end 112. The IFA 120 functions as a radio frequency antenna, but not a millimeter-wave antenna. The IFA 120 may be configured to transceive RF signals of any of a number of standards, such as Long Term Evolution (LTE), a Wi-Fi, a Global Position System (GPS), etc. The IFA 120 and millimeter-wave antenna 112 do not couple with one another, and thus can operate simultaneously and independently.

Figure 2:
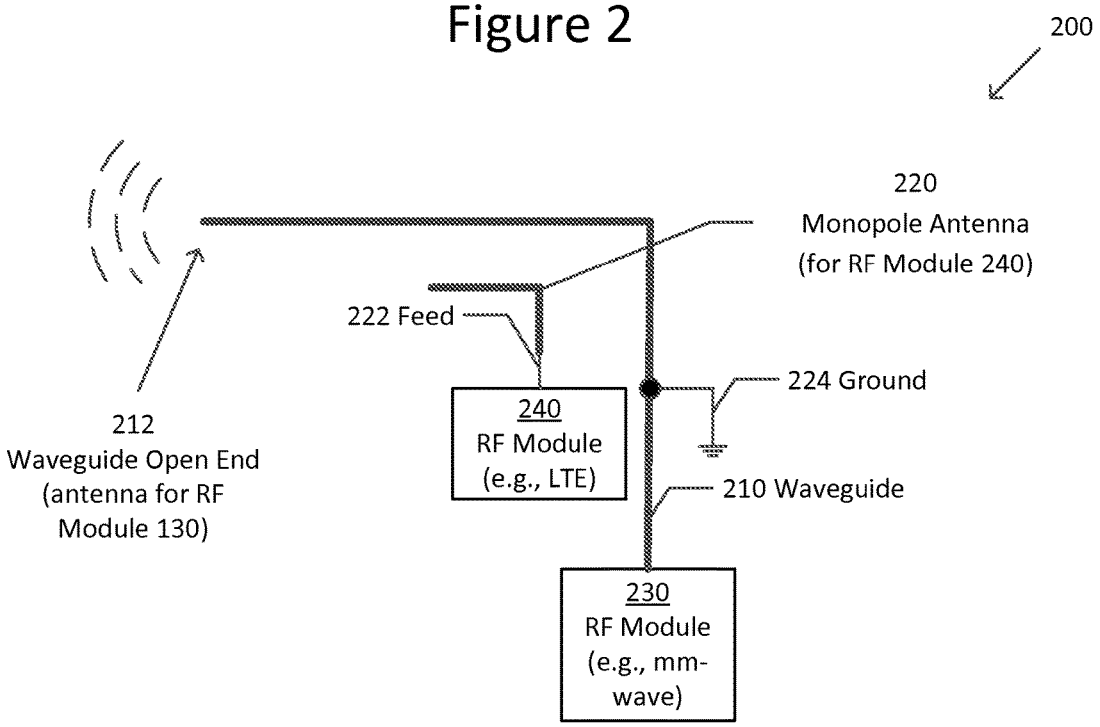
FIG. 2 illustrates a schematic diagram of an antenna structure in accordance with another aspect of the disclosure.

FIG. 2 illustrates a schematic diagram of an antenna structure 200 in accordance with another aspect of the disclosure. Similar elements as those shown in FIG. 1 are labeled with similar references numerals, except that the references numerals begin with a numeral 2 rather than 1. For the sake of brevity, descriptions of similar elements will not be repeated here.

The antenna structure 200 is similar to the antenna structure 100 of FIG. 1, except that rather than an IFA 120 formed from a portion of the waveguide 110, there is a monopole antenna 220 that is in addition to and separate from a waveguide 210. The monopole antenna 220 is formed of a tube similar to that of the waveguide 210.

A monopole antenna is a well-known type of antenna, but is conventionally formed of wire rather than a waveguide tube. The monopole antenna is a straight, rod-shaped conductor, and may be mounted perpendicularly over a ground plane 224. The monopole antenna 220 may be configured to transceive RF signals of any of a number of standards, such as Long Term Evolution (LTE), a Wi-Fi, a Global Position System (GPS), etc.

A millimeter-wave antenna is constructed from an open end 212 of the waveguide 210. The millimeter wave antenna 212 is configured to transceive millimeter-wave signals of the RF module 230.

The waveguide 210 is configured to operate as a parasitic antenna element fed by energy coupled from the monopole antenna 220. In other words, the waveguide antenna 212 and the monopole antenna 220 electromagnetically couple to enhance bandwidth.

Figure 3:
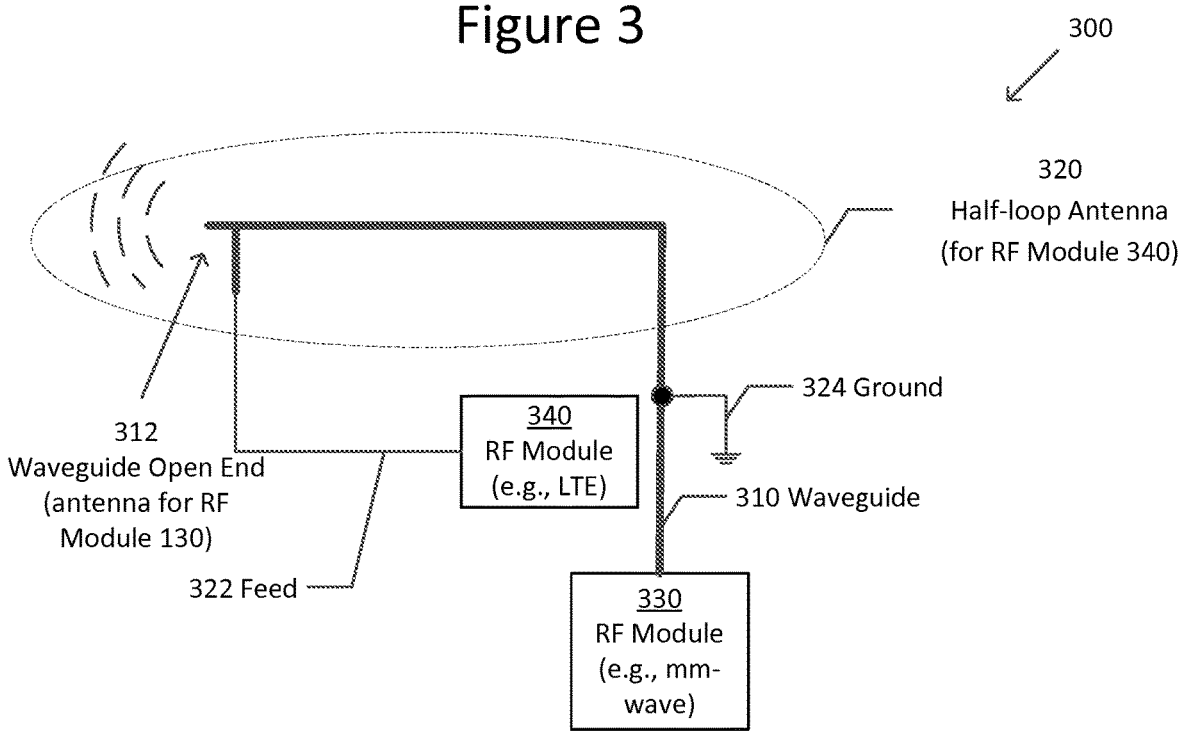
FIG. 3 illustrates a schematic diagram of an antenna structure in accordance with another aspect of the disclosure.

FIG. 3 illustrates a schematic diagram of an antenna structure 300 in accordance with another aspect of the disclosure. Similar elements as those shown in FIG. 1 are labeled with similar references numerals, except that the references numerals begin with a numeral 3 rather than 1. For the sake of brevity, descriptions of similar elements will not be repeated here.

The antenna structure 300 is similar to the antenna structure 100 of FIG. 1, except that rather than an IFA 120, a portion of the waveguide 310 above the ground 324 is shaped as a half-loop antenna 320. A half-loop antenna is a well-known type of antenna, but is conventionally formed of wire rather than a waveguide tube. A feed 322 couples the half-loop antenna 320 to the RF module 340. The half-loop antenna 320 may be configured to transceive RF signals of any of a number of standards, such as Long Term Evolution (LTE), a Wi-Fi, a Global Position System (GPS), etc.

A millimeter-wave antenna is constructed from an open end 312 of the waveguide 310. The millimeter-wave antenna is configured to transceive millimeter-wave signals of the RF module 330. The half-loop antenna 320 and the millimeter-wave antenna 312 do not couple with one another, and thus can operate simultaneously and independently.

Figure 4:
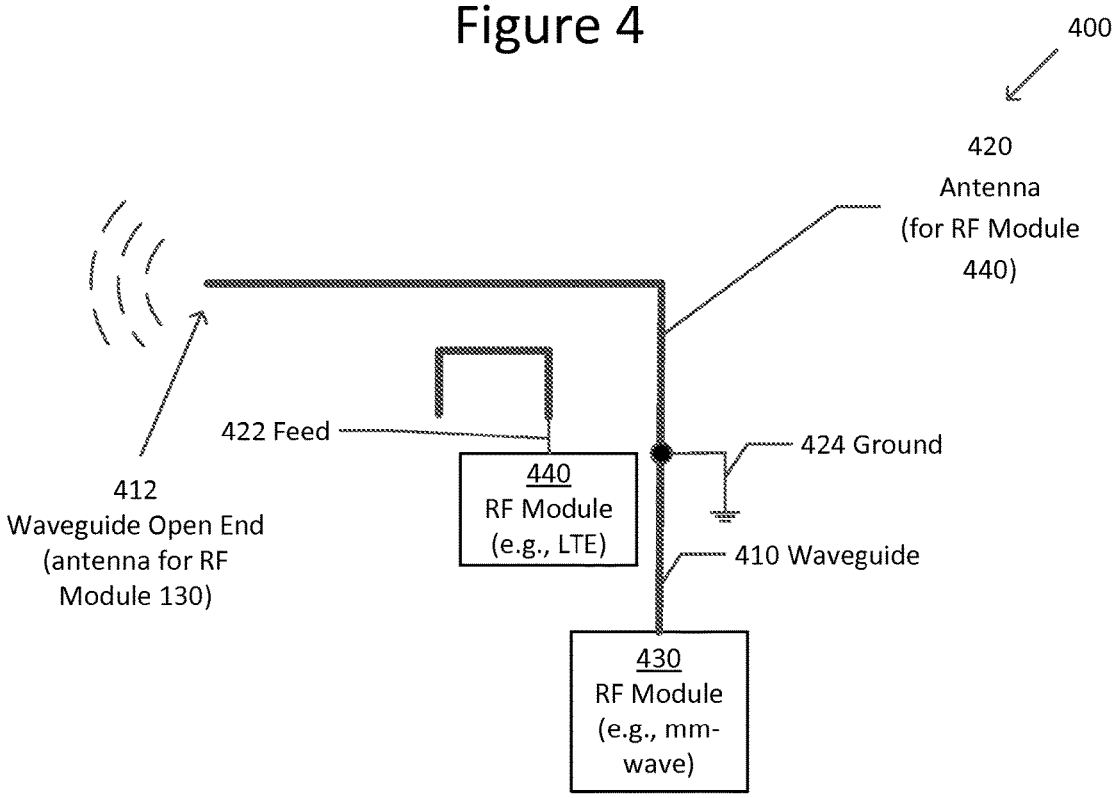
FIG. 4 illustrates a schematic diagram of an antenna structure in accordance with another aspect of the disclosure.

FIG. 4 illustrates a schematic diagram of an antenna structure 400 in accordance with another aspect of the disclosure. Similar elements as those shown in FIG. 2 are labeled with similar references numerals, except that the references numerals begin with a numeral 4 rather than 2. For the sake of brevity, descriptions of similar elements will not be repeated here.

The antenna structure 400 is similar to the antenna structure 200 of FIG. 2, except that the antenna structure 400 comprises an antenna 420 that is indirectly fed by antenna feed 422. The antenna 420 and the antenna feed 422 couple electrically or magnetically or electromagnetically. The antenna 420 may be configured to transceive RF signals of any of a number of standards, such as Long Term Evolution (LTE), a Wi-Fi, a Global Position System (GPS), etc.

A millimeter-wave antenna is constructed from an open end 412 of the waveguide 410. The millimeter-wave antenna 412 is configured to transceive millimeter-wave signals of the RF module 430.

Figure 5:
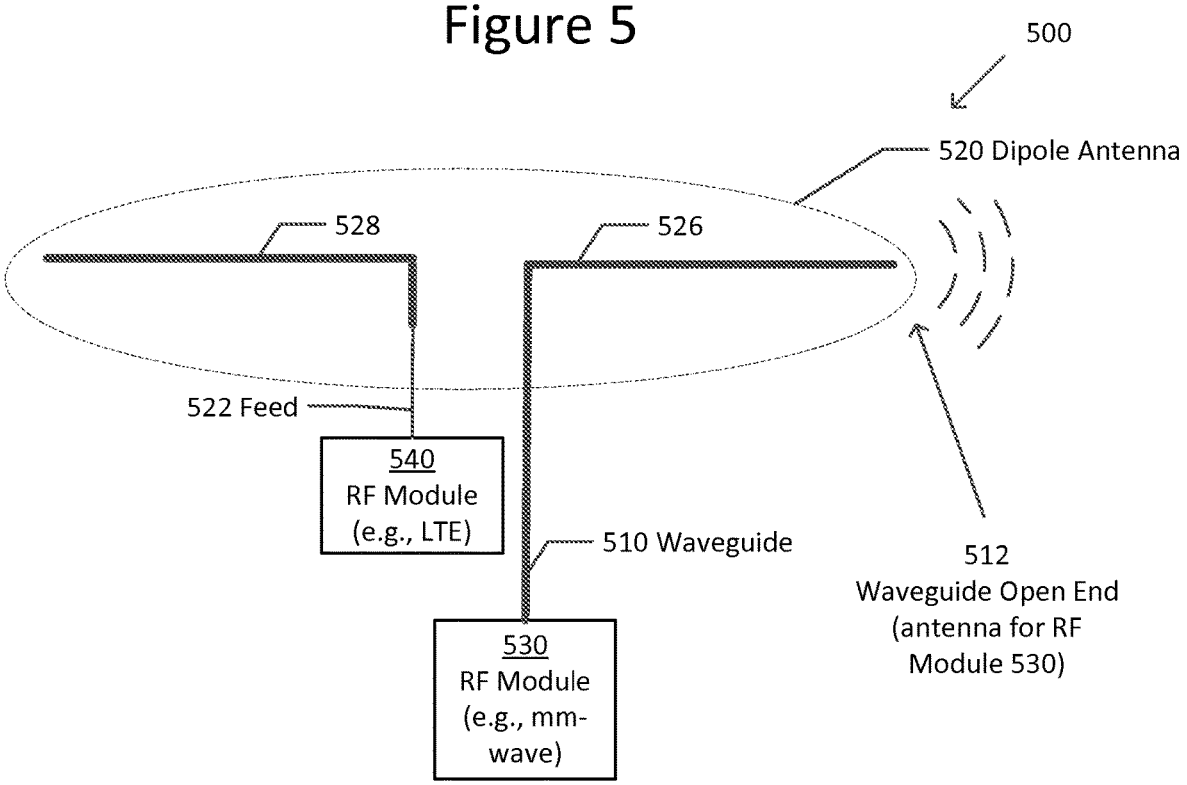
FIG. 5 illustrates a schematic diagram of an antenna structure in accordance with another aspect of the disclosure.

FIG. 5 illustrates a schematic diagram of an antenna structure 500 in accordance with another aspect of the disclosure. Similar elements as those shown in FIG. 1 are labeled with similar references numerals, except that the references numerals begin with a numeral 5 rather than 1. For the sake of brevity, descriptions of similar elements will not be repeated here.

The antenna structure 500 is similar to the antenna structure 100 of FIG. 1, except that rather than an IFA 120, a portion of the waveguide 510 forms half of a dipole antenna 520.

The dipole antenna 520 is a well-known type of antenna, but is conventionally formed of wire rather than a waveguide tube. The dipole antenna 520 comprises a first conductive element 526 and a second conductive element 528, which are substantially identical and are usually bilaterally symmetrical. The first conductive element 526 is shaped from a portion of the waveguide 510. The dipole antenna 520 may be configured to transceive RF signals of any of a number of standards, such as Long Term Evolution (LTE), a Wi-Fi, a Global Position System (GPS), etc. A feed 522 couples the second conductive element 528 to the RF module 540. There is no ground.

A millimeter-wave antenna is constructed from an open end 512 of the first conductive element 526. The millimeter-wave antenna 512 is configured to transceive millimeter-wave signals of the RF module 530. The dipole antenna 520 and the millimeter-wave antenna 312 do not couple with one another, and thus can operate simultaneously and independently. In an alternative aspect, a second or alternative millimeter-wave antenna (not shown) may be constructed from an open end 512 of the second conductive element 528.

The antenna structures 100, 200, 300, 400, 500 of FIGS. 1-5, respectively, are each generally shown as comprising a single waveguide 110. The disclosure is not limited in this respect. Any of these antenna structures may have a plurality of waveguides.

In each of the aspects of the disclosure described above with respect to FIGS. 1-5, the millimeter-wave antenna is described as being located at the open end 112/212/312/412/512 of the waveguide 110/210/310/410/510, but the disclosure is not limited in this respect; a hole may be placed at any location on the waveguide 110/210/310/410/510 to form an antenna. Also, the waveguide 110/210/310/410/510 is described as having a single hole, but the disclosure is not limited in this respect either; the waveguide 110/210/310/410/510 may comprise a plurality of holes configured to operate as respective antennas or an antenna array or multiple antenna arrays having respective frequencies as suitable for the intended purpose. Without a hole, the waveguide 110/210/310/410/510 would operate similar to a conventional wire antenna. Further, the antenna structures 100/200/300/400/500 are described as having a single waveguide 110/210/310/410/510 and a single antenna 120/220/320/420/520, but the disclosure is not limited in this respect; the antenna structure 100/200/300/400/500 may have a plurality of waveguides 110/210/310/410/510 and/or a plurality of antennas 120/220/320/420/520. And the hole(s) in the waveguide 110/210/310/410/510 is/are described as forming a millimeter-wave antenna, but the disclosure is not limited in this respect either; the hole may form an antenna other than a millimeter-wave antenna.

Figure 6:
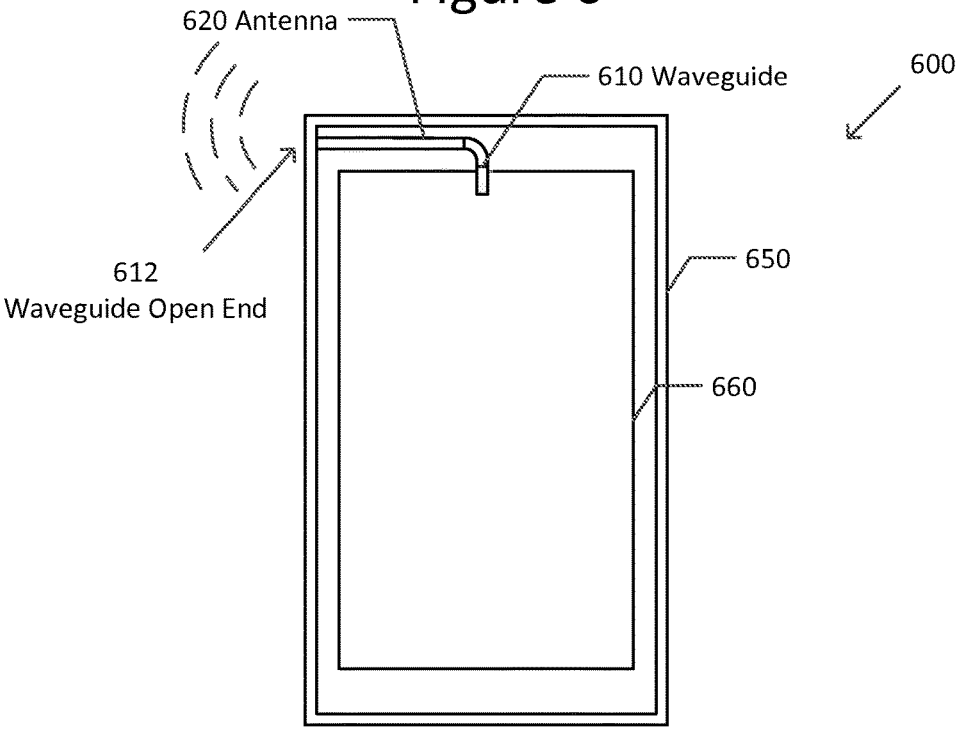
FIG. 6 illustrates a schematic diagram of a wireless communication device in accordance with an aspect of the disclosure.

FIG. 6 illustrates a schematic diagram of a wireless communication device 600 in accordance with an aspect of the disclosure. The wireless communication device 600 may be, for example, a mobile phone, a laptop, a tablet, etc.

The wireless communication device 600 comprises one or more waveguides 610 (i.e., any of 110/210/310/410/510, described above), one or more antennas 620 (i.e., any of 120/220/320/420/520, described above), RF modules (not shown), a body 650, and a display 660. The one or more waveguides 610 may be placed anywhere in the wireless communication device 600 as suitable for the intended purpose. In order to achieve orientation-agnostic millimeter-wave operation, a plurality of waveguides 610 may be located at respective sides of a wireless communication device 600.

Figure 7:
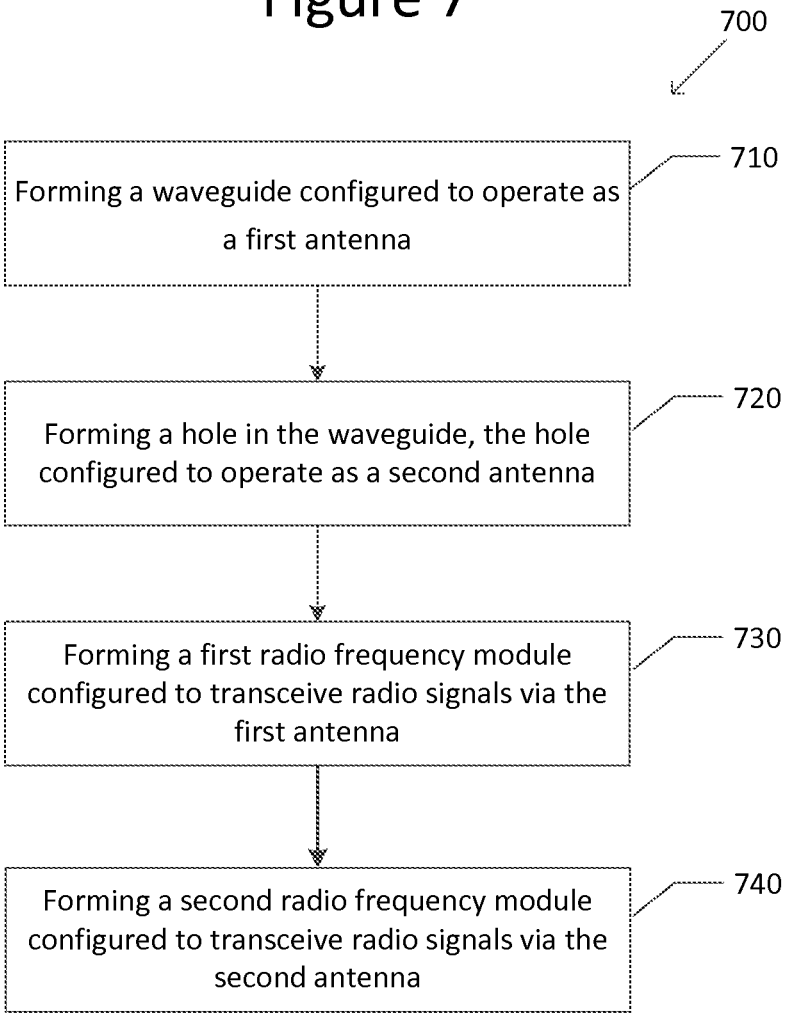
FIG. 7 illustrates a flowchart in accordance with a method of forming a wireless communication device in accordance with one aspect of the disclosure.

FIG. 7 illustrates a flowchart 700 of a method of forming a wireless communication device in accordance with an aspect of the disclosure.

At Step 710, a waveguide 110/210/310/410/510/610 configured to operate as at least a portion of an antenna 120/220/320/420/520 is formed. The waveguide 110/210/310/410/510/610 is shaped to operate as an antenna, such as a Long Term Evolution (LTE) antenna, a Wi-Fi antenna, or a Global Position System (GPS) antenna, or any other antenna suitable for the intended purpose At Step 720, a hole 112/212/312/412/512/612 is formed in the waveguide 110/210/310/410/510/610. The hole 112/212/312/412/512/612 is configured to operate as an antenna, such as a millimeter-wave antenna.

At Step 730, a first RF module 130/230/330/430/530 configured to transceive radio signals via the antenna 120/220/320/420/520 is formed.

At Step 740 a second RF module 140/240/340/440/540 configured to transceive radio signals via the antenna 112/212/312/412/512/612 is formed.

The various aspect of the disclosure has described specific antennas, such as an IFA 120, a monopole antenna 220, a half-loop antenna 320, and a dipole antenna 520. The disclosure is not limited to these types of antennas. The antenna may be any antenna as suitable for the intended purpose.

Example 1 is an antenna structure comprising a waveguide configured to operate as at least a portion of an antenna.

In Example 2, the subject matter of Example 1, wherein the waveguide is configured to operate as a first antenna, and the waveguide defines a hole configured to operate as a second antenna.

In Example 3, the subject matter of Example 2, further comprising: a first radio frequency module configured to transceive radio signals via the first antenna; and a second radio frequency module configured to transceive radio signals via the second antenna.

In Example 4, the subject matter of Example 3, wherein the second radio frequency module is a millimeter-wave radio frequency module.

In Example 5, the subject matter of Example 2, wherein the waveguide defines a plurality of holes configured to operate as respective antennas.

In Example 6, the subject matter of Example 2, wherein the hole is defined at an end of the waveguide.

In Example 7, the subject matter of Example 2, wherein the hole is configured to operate as a millimeter-wave antenna.

In Example 8, the subject matter of Example 1, wherein the waveguide is shaped as an inverted-F antenna.

In Example 9, the subject matter of Example 8, wherein an open end of the waveguide is configured to operate as a millimeter-wave antenna.

In Example 10, the subject matter of Example 1, further comprising: a monopole antenna, wherein the waveguide is configured to operate as a parasitic antenna fed by energy coupled from the monopole antenna.

In Example 11, the subject matter of Example 1, wherein the waveguide is shaped as a half-loop antenna and is configured to operate as a first antenna, and the waveguide defines a hole configured to operate as a second antenna.

In Example 12, the subject matter of Example 11, wherein the second antenna is a millimeter-wave antenna.

In Example 13, the subject matter of Example 1, further comprising: an antenna feed; wherein the antenna and the antenna feed are configured to couple with one another to feed the antenna indirectly.

In Example 14, the subject matter of Example 1, wherein the antenna is a dipole antenna comprising first and second conductive elements, and the first conductive element is formed from the waveguide.

In Example 15, the subject matter of Example 14, wherein the second conductive element is a second waveguide.

In Example 16, the subject matter of Example 1, further comprising a plurality of waveguides.

In Example 17, the subject matter of Example 1, wherein the antenna is configured to operate as a Long Term Evolution antenna.

In Example 18, a wireless communication device comprising the antenna structure of the subject matter of Example 1.

In Example 19, the subject matter of Example 18, wherein the wireless communication device is a laptop.

Example 20 is a wireless communication device, comprising: a waveguide means for operating as at least a portion of an antenna; and a radio frequency module coupled to the waveguide means.

In Example 21, the subject matter of Example 20, wherein the waveguide means is for operating as a first antenna, and defines a hole means for operating as a second antenna.

In Example 22, the subject matter of Example 21, further comprising: a first radio frequency module for transceiving radio signals via the first antenna; and a second radio frequency module for transceiving radio signals via the second antenna.

Example 23 is a method of forming a wireless communication device, comprising: forming a waveguide configured to operate as at least a portion of an antenna; and forming a radio frequency module coupled to the waveguide.

In Example 24, the subject matter of Example 23, wherein the waveguide is configured to operate as a first antenna, and further comprising forming a hole in the waveguide, the hole being configured to operate as a second antenna.

In Example 25, the subject matter of Example 24, wherein the forming the radio frequency module comprises: forming a first radio frequency module configured to transceive radio signals via the first antenna; and forming a second radio frequency module configured to transceive radio signals via the second antenna.

In Example 26, the subject matter of any of Examples 1-7, wherein the waveguide is shaped as an inverted-F antenna.

In Example 27, the subject matter of any of Examples claims 1-7, further comprising: a monopole antenna, wherein the waveguide is configured to operate as a parasitic antenna fed by energy coupled from the monopole antenna.

In Example 28, the subject matter of any of Examples 1-7, wherein the waveguide is shaped as a half-loop antenna and is configured to operate as a first antenna, and the waveguide defines a hole configured to operate as a second antenna.

In Example 29, the subject matter of any of Examples 1-7, further comprising: an antenna feed; wherein the antenna and the antenna feed are configured to couple with one another to feed the antenna indirectly.

In Example 30, the subject matter of any of Examples 1-7, wherein the antenna is a dipole antenna comprising first and second conductive elements, and the first conductive element is formed from the waveguide.

In Example 31, the subject matter of any of Examples 1-14, further comprising a plurality of waveguides.

In Example 32, the subject matter of any of Examples 1-15, wherein the antenna is configured to operate as a Long Term Evolution antenna.

Example 33 is a wireless communication device comprising the subject matter of any of Examples 1-17.

Example 34 is an apparatus substantially as shown and described.

Example 35 is a method substantially as shown and described.

While the foregoing has been described in conjunction with exemplary aspect, it is understood that the term "exemplary" is merely meant as an example, rather than the best or optimal. Accordingly, the disclosure is intended to cover alternatives, modifications and equivalents, which may be included within the scope of the disclosure.

Although specific aspects have been illustrated and described herein, it will be appreciated by those of ordinary skill in the art that a variety of alternate and/or equivalent implementations may be substituted for the specific aspects shown and described without departing from the scope of the present application. This application is intended to cover any adaptations or variations of the specific aspects discussed herein.

The invention claimed is:

1. An antenna structure, comprising:

a waveguide formed from a single conductor and including an opening;

a first antenna feed coupled to the antenna structure at a first location to cause the single conductor of the waveguide to operate as at least a portion of a first antenna; and a second antenna feed coupled to the single conductor of the waveguide at a second location to cause the opening in the waveguide to operate as a second antenna, and wherein the first antenna is configured to operate by transceiving radio signals (i) exclusively via the single conductor of the waveguide operating as the portion of the first antenna in conjunction with the first antenna feed and independently of other portions of the antenna structure, and (ii) irrespective of the opening in the waveguide.

2. The antenna structure of claim 1, further comprising:

a first radio frequency transceiver circuit configured to transceive radio signals via the first antenna; and a second radio frequency transceiver circuit configured to transceive radio signals via the second antenna.

3. The antenna structure of claim 2, wherein the second radio frequency transceiver circuit is a millimeter-wave radio frequency transceiver circuit .

4. The antenna structure of claim 1, wherein the opening is from among a plurality of openings, with each one of the plurality of openings being configured to operate as a respective antenna.

5. The antenna structure of claim 1, wherein the opening is disposed at an end of the waveguide.

6. The antenna structure of claim 1, wherein the second antenna is configured to operate as a millimeter-wave antenna.

7. The antenna structure of claim 1, wherein the waveguide is configured as an inverted-F antenna (IFA).

8. The antenna structure of claim 7, wherein the opening in the waveguide is disposed at an open end of the waveguide, the second antenna being configured to operate at millimeter-wave frequencies.

9. The antenna structure of claim 1, wherein the first antenna feed is configured to indirectly couple with the waveguide that forms the at least a portion of the first antenna.

10. The antenna structure of claim 1, wherein the first antenna is configured to operate as a Long Term Evolution antenna.

11. A wireless communication device, comprising:

an antenna structure, including:

a waveguide formed from a single conductor and including an opening;

a first antenna feed coupled to the antenna structure at a first location to cause the single conductor of the waveguide to operate as at least a portion of a first antenna; and a second antenna feed coupled to the single conductor of the waveguide at a second location to cause the opening in the waveguide to operate as a second antenna, wherein the first antenna is configured to operate by transceiving radio signals (i) exclusively via the single conductor of the waveguide operating as the portion of the first antenna in conjunction with the first antenna feed and independently of other portions of the antenna structure, and (ii) irrespective of the opening in the waveguide.

12. The wireless communication device of claim 11, further comprising:

a first radio frequency transceiver circuit configured for transceiving radio signals via the first antenna; and a second radio frequency transceiver circuit configured for transceiving radio signals via the second antenna.

13. A method of forming a wireless communication device including an antenna structure, the method comprising:

forming a waveguide from a single conductor, the waveguide being configured to operate as at least a portion of a first antenna;

forming an opening in the waveguide;

coupling a first antenna feed to the antenna structure at a first location to cause the single conductor of the waveguide to operate as at least a portion of the first antenna; and coupling a second antenna feed to the single conductor of the waveguide at a second location to cause the opening formed in the waveguide to operate as a second antenna, wherein the first antenna is configured to operate by transceiving radio signals (i) exclusively via the single conductor of the waveguide operating as the portion of the first antenna in conjunction with the first antenna feed and independently of other portions of the antenna structure, and (ii) irrespective of the opening in the waveguide.

14. The method claim 13, further comprising:

forming a first radio frequency transceiver circuit configured to transceive radio signals via the first antenna; and forming a second radio frequency transceiver circuit configured to transceive radio signals via the second antenna.

15. The wireless communication device of claim 11, wherein the wireless communication device is a laptop.

16. The antenna structure of claim 3, wherein the second radio frequency transceiver circuit is coupled to the waveguide via the second antenna feed to cause the opening in the waveguide to transceive radio signals in accordance with millimeter- wave radio frequencies.

17. The antenna structure of claim 2, wherein the first radio frequency transceiver circuit and the second radio frequency transceiver circuit are configured to operate independently to transceive radio signals via the first antenna and the second antenna, respectively.

18. The antenna structure of claim 1, wherein the first location associated with the coupling of the first antenna feed is a different location than the second location associated with the coupling of the second antenna feed.

19. The antenna structure of claim 1, wherein:

the waveguide is coupled to a ground that grounds the outside of the waveguide and isolates a portion of the waveguide associated with the at least a portion of the first antenna from a remainder of the waveguide, the first antenna is configured to operate in conjunction with the first antenna feed and the ground, and the second antenna is configured to operate irrespective of the ground by transceiving signals propagating through an inside of the waveguide.

20. The antenna structure of claim 19, wherein the at least a portion of the first antenna operates by transceiving radio signals via the isolated a first portion of the waveguide that is associated with the at least a portion of the first antenna located on a first side of the ground.

21. The antenna structure of claim 19, wherein the second antenna feed is coupled to the waveguide via a second side of the ground at a location that is associated with the remainder of the waveguide that is isolated from the at least a portion of the first antenna different from the first side of the ground.

* * * * *